United States Patent [19]

Murphy

[11] Patent Number: 4,787,188

[45] Date of Patent: Nov. 29, 1988

[54] STRESS PLATE AND METHOD OF USING SAME FOR SECURING A ROOF MEMBRANE TO A ROOF DECK

[75] Inventor: Colin R. Murphy, Augusta, N.J.

[73] Assignee: Engineered Construction Components

[21] Appl. No.: 106,991

[22] Filed: Oct. 5, 1987

Related U.S. Application Data

[63] Continuation of Ser. No. 815,551, Jan. 2, 1986, abandoned.

[51] Int. Cl.[4] ..... E04B 5/00; E04B 1/38

[52] U.S. Cl. ..... 52/410; 52/512; 52/746; 411/531

[58] Field of Search ..... 52/410, 199, 512, 746, 52/543; 24/141; 411/487, 161, 162, 545, 477, 531

[56] References Cited

U.S. PATENT DOCUMENTS 4,380,413 4/1983 Dewey ..... 52/410

4,543,763 10/1985 Ernst et al. ..... 411/531

*Primary Examiner*—James L. Ridgill, Jr.

*Attorney, Agent, or Firm*—Elliot M. Olstein; Raymond J. Lillie

[57] ABSTRACT

A stress plate and method for securing a membrane to a roof deck wherein the plate includes gripping prongs which grip the membrane, preferably without piercing the membrane, wherein a stress plate surface having the gripping prongs is placed in contact with a top surface of a roof membrane to clamp the membrane to a roof structure.

23 Claims, 3 Drawing Sheets

STRESS PLATE AND METHOD OF USING SAME FOR SECURING A ROOF MEMBRANE TO A ROOF DECK

This is a continuation of application Ser. No. 815,551 filed Jan. 2, 1986, now abandoned.

This invention relates to stress plates, and more particularly to stress plates for clamping a membrane to a roof deck.

Stress plates have been previously used for clamping a membrane to a roof deck. In general, the stress plate is placed over the membrane, and a fastening means, such as a screw, is inserted through an opening in the center of the plate, and through the membrane, with the fastening means being secured to the roof deck, whereby the membrane is clamped to the roof deck by the stress plate. In such an assembly, if the screw loosens, the membrane can slide out from underneath the stress plate.

In accordance with one aspect of the present invention, there is provided a stress plate for clamping a membrane to a roof deck (insulating material may or may not be between the membrane and the roof deck), with the stress plate having a top surface and a bottom surface which is clamped against the membrane. The stress plate is provided with an opening for receiving a fastening means, such as a screw, for securing the clamping plate over the membrane to the roof deck. The stress or clamping plate is further provided with at least three spaced prongs which extend outwardly from the bottom surface of the plate, with the prongs having a length such that the prongs grip the roof membrane. In accordance with a particularly preferred embodiment, the prongs have a length such that they grip the roof membrane without puncturing through the roof membrane.

In this manner, the membrane is held to the roof deck by the fastening means, with the spaced prongs gripping the membrane so as to prevent the membrane from slipping out from underneath the stress plate.

The invention will be further described with respect to the accompanying drawings, wherein.

Figure 1:
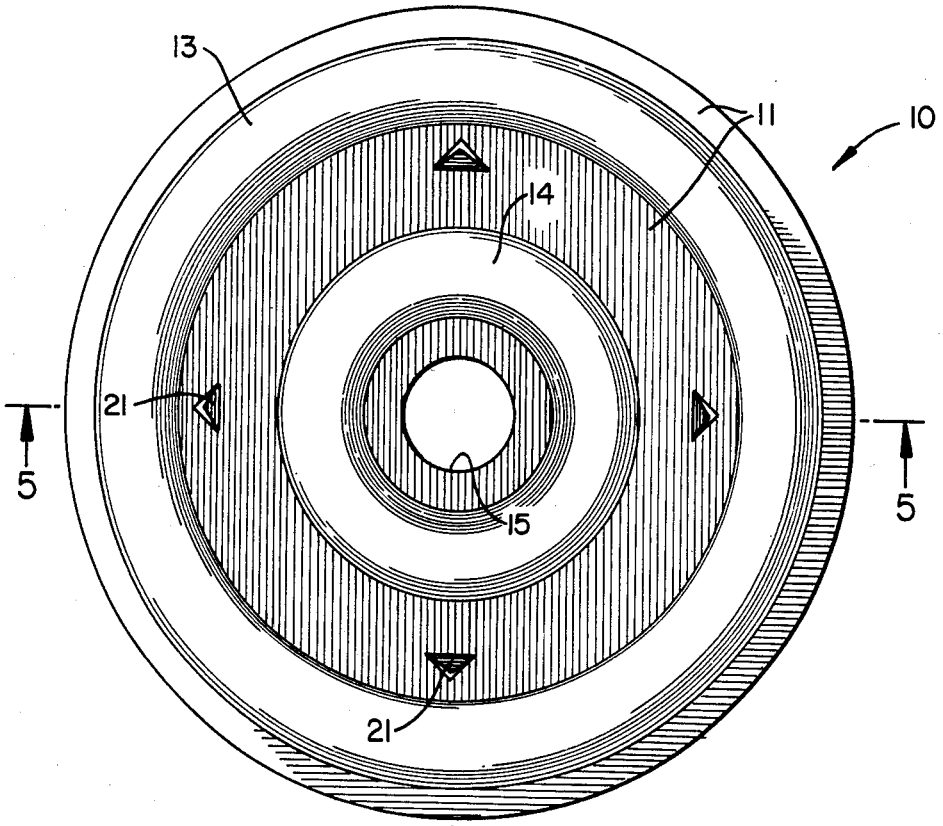
FIG. 1 is a top view of an embodiment of a stress plate in accordance with the present invention.
Figure 2:
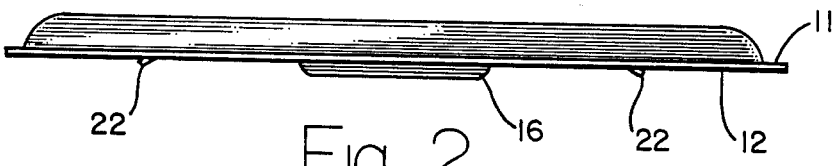
FIG. 2 is a side view of the embodiment of the stress plate shown in FIG. 1.
Figure 3:
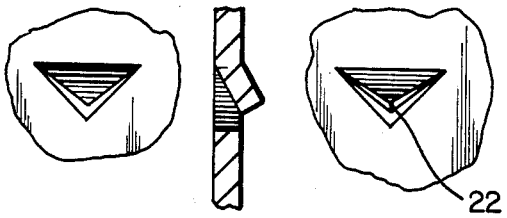
FIG. 3 is a detail of the gripping prongs or fingers of the embodiment of the stress plate shown in FIG. 1, illustrated in the top, cross-sectional and bottom views, respectively.

Referring now to FIGS. 1-3 of the drawings, there is shown a circular stress plate, generally designated as 10, having a top surface 11 and a bottom surface 12. The top surface 11 of the stress plate 10 is provided with an outer circular rib, generally designated as 13 and an inner circular rib, generally designated as 14 for reinforcing the plate. The stress plate 10 further includes a central circular opening 15 for receiving an appropriate fastening means, such as a screw, for fastening the stress plate over a roof membrane and to the roof deck. The lower surface 12 is provided with a central hub 16, which surrounds the opening 15.

The stress plate is further provided with four gripping prongs, generally designated as 21, which are circumferentially spaced from each other by 90 degrees.

The prongs 21 have a generally triangular shape are integral with and extend angularly outwardly from the bottom surface 12, and terminate in a gripping point, generally designated as 22.

The prongs 21 preferably have a length such that they grip a roof membrane, without puncturing entirely through the membrane.

The gripping prongs or fingers 21 may be formed by cutting a triangular tab-like section from the surface of the plate, and appropriately bending such tab so as to form the gripping prongs 21.

Although four gripping prongs have been shown, it is to be understood that the plate could be formed with three gripping prongs, or more than four gripping prongs.

Figure 4:
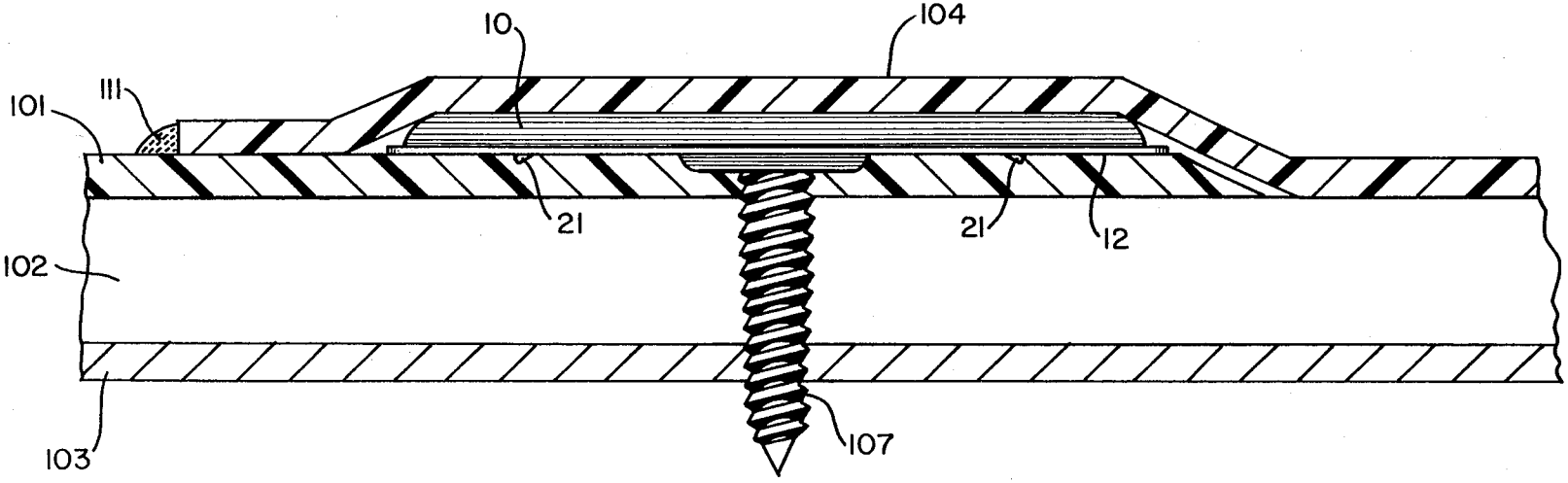
FIG. 4 is cross-sectional views illustrating the use of the stress plate of FIG. 1 for clamping a roof membrane to a roof deck.

Referring now to FIG. 4, there is illustrated the manner in which a stress plate in accordance with the present invention is employed for use in providing a roof covering. As shown in FIG. 4, the stress plate is employed for fastening the roof membrane to the roof deck at the portions of the membrane where a seam is formed. More particularly, the membrane is applied to the deck surface, at the seam portion, as an overlap fit, with a lower sheet or membrane 101 being fastened over insulation 102 to a roof deck surface 103 by use of the stress plate 10, and a fastening means, such as a screw 107. A top sheet or membrane 104 is then lapped over the first sheet 101 so as to cover the stress plate 10, with the top sheet 104 being secured to the lower sheet 101 by a welded seam 111.

The stress plate 10 is positioned with the lower surface 12 in contact with the lower sheet 101 in a manner such that the prongs 21 grip the lower sheet 101, without puncturing through the lower sheet. Moreover, applicant has found that if the plate is produced so that the prongs do not puncture through the membrane, the membrane is not weakened and is more capable of resisting forces, such as that caused by winds, without tearing. In this manner, the lower sheet 101 will not slide out from underneath the stress plate 10, even if the screw which secures the stress plate 10 to the roof deck is loosened.

The stress plate is generally made from a wide variety of materials, including metals, such as galvanized carbon steel, stainless steel, etc. In addition, such stress plates may be made from plastic, or from plastic with a metal insert so as to increase pullover and strengthen the gripping fingers.

Figure 5:
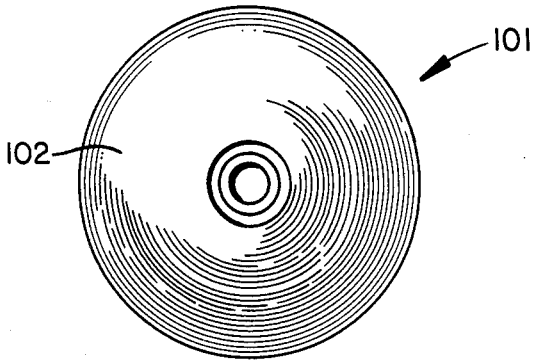
FIG. 5 is a top view of another embodiment of a stress plate in accordance with the present invention.
Figure 6:
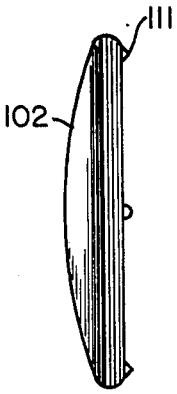
FIG. 6 is a side view of the embodiment of FIG. 5.
Figure 8:
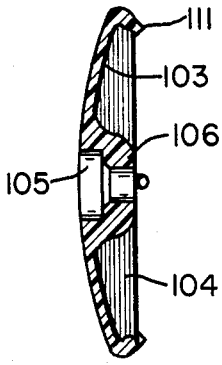
FIG. 8 is a sectional view taken along line 8—8 of FIG. 7.
Figure 7:
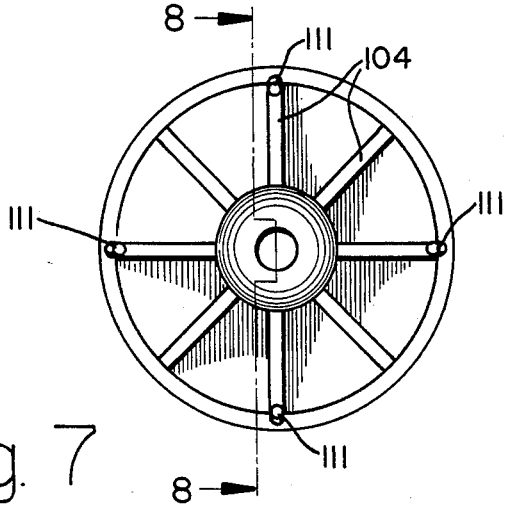
FIG. 7 is a bottom view of the embodiment of FIG. 5.

Referring now to FIGS. 5-7 of the drawings, there is illustrated another embodiment of a stress plate of the present invention, which is preferably formed of plastic.

Referring to FIGS. 5-7 of the drawings, there is shown a circular stress plate, generally designated as 101, which is preferably formed of plastic, and which has a convex top surface 102 and a concave bottom surface 103. The bottom surface 103 of the stress plate 101 is provided with radially extending ribs 104 for reinforcing the plate.

The plate 101 further includes a recessed central opening 105 for receiving an appropriate fastening means, such as a screw, for fastening the stress plate over a roof membrane and to the roof deck. The lower surface 103 is provided with a central hub 106, which surrounds the opening 105.

The stress plate 101 is further provided with four gripping prongs, generally designated as 111, which are circumferentially spaced from each other by 90 degrees at the outer periphery of the stress plate 101.

The prongs 111 have a generally triangular shape are integral with and extend outwardly from the bottom surface 103, and terminate in a gripping point. The prongs 111 preferably have a length such that they grip a roof membrane without puncturing entirely through the membrane.

The plate 101 is used in a manner similar to the stress plate 10 described with reference to FIGS. 1–3.

As a result of the concave lower surface, and the flexibility of the plastic, upon clamping of the plate 101, the force is transmitted to the outer periphery of plate 101 which increases the gripping power of prongs 111.

The stress plates can come in a variety of sizes, with the stress plates generally being made with either a two inch or three inch outside diameter, and with a 0.260 inch inside diameter.

The stress plate of the present invention is particularly advantageous in that a roof membrane is more securely fastened to a roof deck in that the membrane cannot slide out from underneath the stress plate. Moreover, the gripping prongs or fingers are positioned on the stress plate so that the plate can be set without the necessity of turning the plate for proper placement.

Moreover, the membrane is held by the plate by both compression and by being gripped. Furthermore, such a result is achieved without puncturing entirely through the roof membrane.

These and other advantages should be apparent to those skilled in the art from the teachings herein.

Numerous modifications and variations of the present invention are possible in light of the above teachings and, therefore, within the scope of the appended claims, the invention may be practiced otherwise than as particularly described.

What is claimed is:

1. In a roof including a roof membrane, the improvement comprising:

a stress plate having a top surface and a bottom surface, said plate including an opening for receiving a fastening means for securing the stress plate to a roof, said bottom surface being in contact with a roof membrane portion which is in contact with the roof, said stress plate having at least three spaced prongs extending outwardly from the bottom surface of said plate, said at least three spaced prongs being unitary with said plate; and fastening means received in said opening and secured to the roof, said prongs gripping the top surface of said membrane portion which is in contact with the roof, said stress plate clamping the membrane between the bottom surface of the stress plate and the roof.

2. The improvement of claim 1 wherein the plate includes four gripping prongs circumferentially spaced from each other by 90 degrees.

3. The improvement of claim 1 wherein said prongs grip and indent said top surface of said membrane without puncturing entirely through said membrane.

4. The improvement of claim 1 wherein said opening is recessed in said top surface.

5. The improvement of claim 1 wherein the plate is a circular plate.

6. The improvement of claim 5 wherein the opening is a central opening.

7. The improvement of claim 1 wherein the plate is formed from plastic and the plate has a concave lower surface.

8. The improvement of claim 7 wherein the plate is a circular plate and the prongs are positioned adjacent to the periphery of the plate.

9. The improvement of claim 1 wherein the roof is comprised of a roof deck and roof insulation and the bottom surface of the stress plate is in contact with the roof membrane.

10. The improvement of claim 9 wherein said stress plate is in contact with a roof membrane portion which is overlaped with another roof membrane portion.

11. The improvement of claim 1 wherein said prongs have a substantially triangular shape.

12. The improvement of claim 11 wherein said plate includes four gripping prongs circumferentially spaced from each other by 90 degrees.

13. The improvement of claim 11 and further comprising insulating material between the roof membrane and roof deck.

14. The improvement of claim 1 wherein the stress plate includes at least one rib, for reinforcing said plate.

15. The improvement of claim 14 wherein the gripping prongs have a substantially triangular shape.

16. The improvement of claim 14, wherein said bottom surface includes a raised hub portion adjacent to said opening.

17. The improvement of claim 1 wherein the plate is formed from plastic and the plate has a concave lower surface.

18. The improvement of claim 17 wherein the plate is a circular plate and the prongs are positioned adjacent to the periphery of the plate.

19. The improvement of claim 18 wherein the prongs have a length which grips a roof membrane without puncturing entirely through the roof membrane.

20. A method of securing a roof membrane, to a roof comprising:

placing a stress plate having at least three spaced prongs on a bottom surface thereof with the bottom surface in contact with a top surface of a roof membrane portion which is in contact with a roof, said at least three spaced prongs being unitary with said plate; and clamping said roof membrane between said bottom surface of the stress plate and the roof by securing to a roof a fastening means positioned in an opening in the stress plate, said clamping providing gripping contact between said prongs and a top surface of said membrane portion which is in contact with the roof.

21. The method of claim 20 wherein said prongs indent the top surface of said roof membrane without puncturing entirely through said roof membrane.

22. The method of claim 20 wherein the roof is comprised of a roof deck and roof membrane and the bottom surface of the stress plate is in contact with the roof membrane.

23. The method of claim 22 wherein the stress plate is placed in contact with a top surface of a roof membrane portion which is overlaped with another roof membrane portion.

* * * * *

UNITED STATES PATENT AND TRADEMARK OFFICE

CERTIFICATE OF CORRECTION

PATENT NO. : 4,787,188

DATED : Nov. 29, 1988

INVENTOR(S) : Colin R. Murphy

It is certified that error appears in the above-identified patent and that said Letters Patent is hereby corrected as shown below:

On the title page, under item [56] References Cited, U.S. PATENT DOCUMENTS, add the following references:

| | | |
|---|---|---|
| 4,520,606 | 06/1985 | Frankovitch |
| 382,921 | 05/1888 | Wilcox |
| 382,923 | 05/1888 | Wilcox |
| 4,490,952 | 01/1985 | Winston |
| 624,150 | 05/1899 | Andrus |
| 4,620,402 | 11/1986 | Beneze |
| 945,127 | 01/1910 | Kollenberg |
| 795,533 | 07/1905 | Sherman |
| 1,435,134 | 11/1922 | Boley |
| 2,207,897 | 07/1940 | Schaus |
| 4,361,997 | 12/1982 | De Caro |
| 4,467,581 | 08/1984 | Frankovitch |
| 4,455,804 | 06/1984 | Frankovitch |
| 4,574,551 | 03/1986 | Giannuzzi |

UNITED STATES PATENT AND TRADEMARK OFFICE

CERTIFICATE OF CORRECTION

PATENT NO. : 4,787,188

DATED : Nov. 29, 1988

INVENTOR(S) : Colin R. Murphy

It is certified that error appears in the above-identified patent and that said Letters Patent is hereby corrected as shown below:

On the title page, under item [56] References Cited, and after U.S. DOCUMENTS, add the following:

FOREIGN PATENT DOCUMENTS

| | | |
|---|---|---|
| 1,300,835 | 07/1962 | France |
| 74/5863 | 06/1976 | Netherlands |

Signed and Sealed this

Fourteenth Day of May, 1991

*Attest:*

*Attesting Officer*

HARRY F. MANBECK, JR.

*Commissioner of Patents and Trademarks*